US012428921B2

(12) United States Patent
Borg et al.

(10) Patent No.: US 12,428,921 B2
(45) Date of Patent: Sep. 30, 2025

(54) DOWNHOLE WIRELINE TOOL

(71) Applicant: WELLTEC A/S, Allerød (DK)

(72) Inventors: Peder Løkke Borg, Allerød (DK); Tomas Sune Andersen, Allerød (DK)

(73) Assignee: WELLTEC A/S, Allerød (DK)

( * ) Notice: Subject to any disclaimer, the term of this patent is extended or adjusted under 35 U.S.C. 154(b) by 0 days.

(21) Appl. No.: 18/758,363

(22) Filed: Jun. 28, 2024

(65) Prior Publication Data

US 2025/0003305 A1 Jan. 2, 2025

(30) Foreign Application Priority Data

Jun. 30, 2023 (EP) ..... 23182865

(51) Int. Cl.

| | |
|---|---|
| ***E21B 29/00*** | (2006.01) |
| ***E21B 4/00*** | (2006.01) |
| ***E21B 4/04*** | (2006.01) |
| ***E21B 23/00*** | (2006.01) |

(52) U.S. Cl.

CPC ..... *E21B 29/002* (2013.01); *E21B 4/006* (2013.01); *E21B 4/04* (2013.01); *E21B 23/001* (2020.05)

(58) Field of Classification Search

CPC ..... E21B 29/002; E21B 4/006; E21B 4/04; E21B 23/001

See application file for complete search history.

(56) References Cited

U.S. PATENT DOCUMENTS 4,192,380 A * 3/1980 Smith ..... E21B 23/14 166/66.4
9,759,040 B2 * 9/2017 Nguyen ..... E21B 43/14
10,316,602 B2 6/2019 Andersen
11,649,678 B1 5/2023 Wang
2008/0135226 A1 * 6/2008 Lewis ..... E21B 29/005 166/55

(Continued)

FOREIGN PATENT DOCUMENTS

GB 2523160 A 8/2015

OTHER PUBLICATIONS

Extended European Search Report for EP 23182865, dated Dec. 1, 2023, 7 pages.

*Primary Examiner* — Robert E Fuller
(74) *Attorney, Agent, or Firm* — Nixon & Vanderhye P.C.

(57) ABSTRACT

The present invention relates to a downhole wireline tool for performing an operation on a rotatable component part mounted as part of a well tubular metal structure in a well, the downhole wireline tool having an axial extension and a front face facing away from a top of the well, and the downhole wireline tool comprising a wireline connection unit for connection to a wireline, an electric motor powered by the wireline for rotating a rotatable shaft, and a gearing system driven by the electric motor, the gearing system comprising a first gearing part connected with the rotatable shaft and configured to rotate in a first direction, wherein the gearing system further comprises an intermediate gearing part rotated by the first gearing part and a second gearing part rotated by the intermediate gearing part to rotate in a second direction opposite the first direction. The invention also relates to a downhole system comprising the downhole wireline tool and a driving unit, such as a downhole tractor, for propelling the downhole system forward in the well.

15 Claims, 8 Drawing Sheets

(56) References Cited

U.S. PATENT DOCUMENTS

Figure 1:
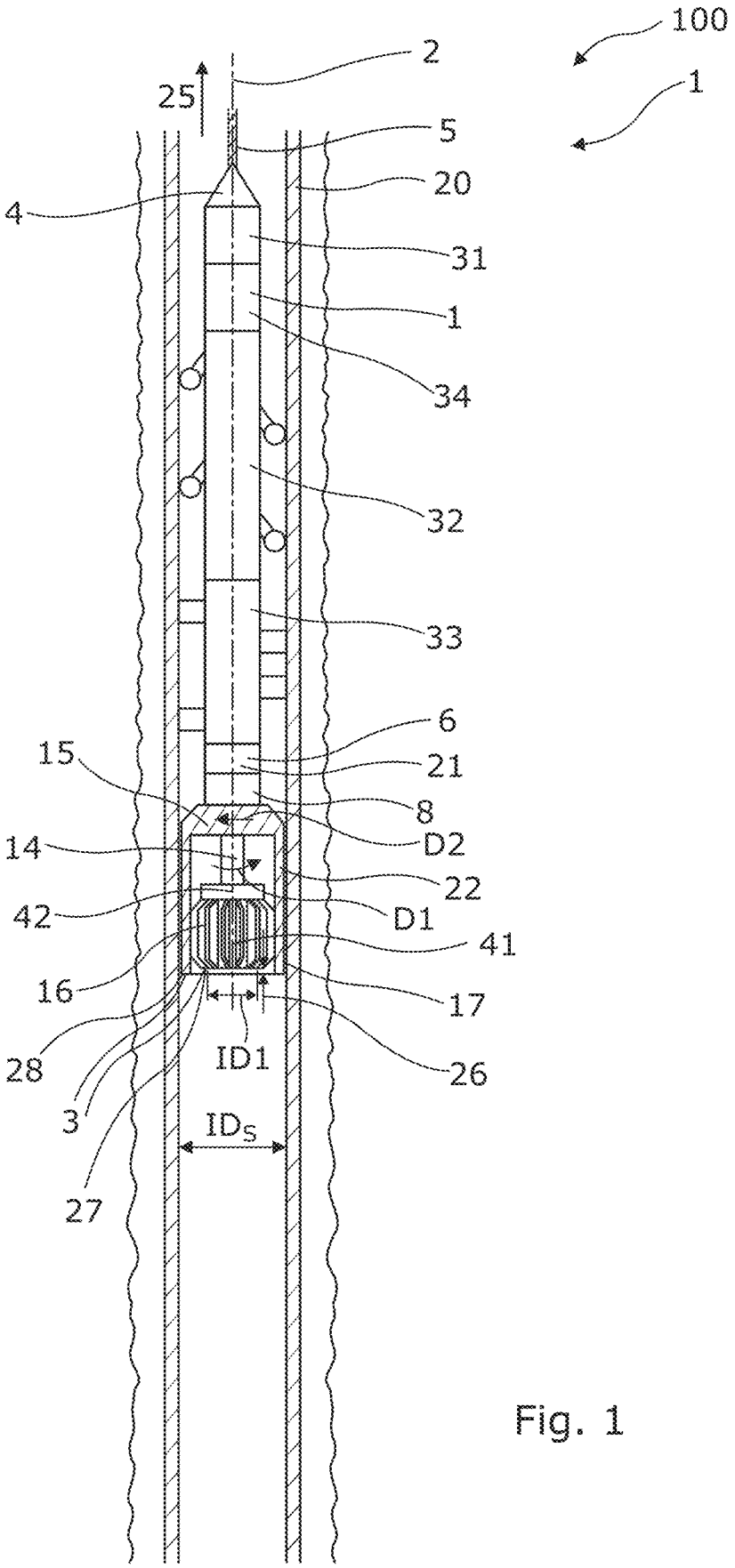

| | | | | |
|---|---|---|---|---|
| 2008/0135292 | A1* | 6/2008 | Sihler | E21B 44/005 175/27 |
| 2015/0300113 | A1* | 10/2015 | Guttormsen | E21B 4/18 166/243 |
| 2016/0215564 | A1 | 7/2016 | Andersen et al. | |
| 2016/0222734 | A1 | 8/2016 | Winslow et al. | |
| 2016/0356089 | A1 | 12/2016 | Nanayakkara et al. | |
| 2018/0058146 | A1* | 3/2018 | Gråbæk | E21B 4/04 |
| 2019/0264548 | A1* | 8/2019 | Zhao | E21B 43/119 |
| 2021/0285289 | A1 | 9/2021 | Wang et al. | |

* cited by examiner

DOWNHOLE WIRELINE TOOL

CROSS-REFERENCE TO RELATED APPLICATION

This application claims priority to European Patent Application EP 23182865.8 filed Jun. 30, 2023, the entire contents of which are hereby incorporated by reference.

DESCRIPTION

The present invention relates to a downhole wireline tool for performing an operation on a rotatable component part mounted as part of a well tubular metal structure in a well, the downhole wireline tool having an axial extension and a front face facing away from a top of the well. The invention also relates to a downhole system comprising the downhole wireline tool and a driving unit, such as a downhole tractor, for propelling the downhole system forward in the well.

BACKGROUND

During fracturing operations, balls with varying diameters are dropped down the well in order to be seated in a matching ball seat, and some balls are designed to release and others to dissolve after a predetermined period of time. When this operation fails, the balls need to be drilled out, which can be very troublesome as machining in a rotating object is not easy, and therefore several designs have been tried out. Also, when drilling out other objects such as a stuck plug rotating, part of the plug may hinder easy removal as a rotating object like the ball just rotates along with the rotating drilling bit seeking to drill out the ball or plug.

It is an object of the present invention to wholly or partly overcome the above disadvantages and drawbacks of the prior art. More specifically, it is an object to provide an improved downhole wireline tool also able to drill out rotating objects in a completion, such as a ball in a ball seat or a rotatable part of a stuck plug, of a well in an easy, safe and quick manner.

The above objects, together with numerous other objects, advantages and features, which will become evident from the below description, are accomplished by a solution in accordance with the present invention by a downhole wireline tool for performing an operation on a rotatable component part mounted as part of a well tubular metal structure in a well, the downhole wireline tool having an axial extension and a front face facing away from a top of the well, and the downhole wireline tool comprising:

- a wireline connection unit for connection to a wireline,
- an electric motor powered by the wireline for rotating a rotatable shaft, and
- a gearing system driven by the electric motor, the gearing system comprising a first gearing part connected with the rotatable shaft and configured to rotate in a first direction, wherein the gearing system further comprises an intermediate gearing part rotated by the first gearing part and a second gearing part rotated by the intermediate gearing part to rotate in a second direction opposite the first direction.

By having a gearing system where the output of the gear is a first gearing part rotating in one direction and a second gearing part rotating in an opposite direction, the downhole wireline tool is able to mill out e.g. a ball in a ball seat even though the ball is able to rotate.

Also, the first gearing part may be connected to a first output shaft rotatable with the first gearing part in the first direction, and the second gearing part may be connected to a second output shaft that is hollow and rotatable with the second gearing part in the second direction, the first output shaft extending through the second output shaft.

Moreover, the downhole wireline tool may further comprise a first machining bit forming the front face and being connected to and rotated by the first output shaft.

Furthermore, the second output shaft may be a hollow shaft rotating around the first output shaft.

Thus, the second output shaft may comprise a fluid channel or a channel for an electric line.

In addition, the second output shaft may be connected to a gripping element or a second machining bit forming the front face and being connected to and rotated by the second output shaft.

Further, the first machining bit may be hollow.

Also, the first machining bit may have a first outer diameter, and the second machining bit may have a second inner diameter that is larger than the first outer diameter.

Furthermore, the first machining bit may be tubular, having a first inner diameter that is less than 10 mm smaller than the first outer diameter, preferably less than 7 mm, and more preferably less than 5 mm.

In addition, the second machining bit may be tubular, having a second inner diameter that is less than 10 mm smaller than the second outer diameter, preferably less than 7 mm, and more preferably less than 5 mm.

Moreover, the second inner diameter may be less than 5 mm larger than the first outer diameter.

In addition, the first machining bit has a first end face, the second machining bit has a second end face, and the first end face and the second face are arranged in the same plane extending transversely to the axial extension. Thus, the first end face and the second end face form the front face of the tool.

In addition, the first machining bit has a first end face, the second machining bit has a second end face, and the first end face and the second face are arranged having an axial distance along the axial extension being less than 5 cm, preferably less than 2.5 cm in order to engage the curvature of a ball simultaneously.

Further, the first machining bit may comprise inserts extending from the front face along the axial extension.

Also, the second machining bit may be a tubular second machining bit having a circumference and circumferenting the first machining bit.

Furthermore, the second machining bit may comprise inserts extending from the front face along the axial extension.

In addition, the second machining bit may comprise inserts distributed along the circumference.

Moreover, the inserts may be abrasive inserts.

Further, the inserts may comprise grains and binder.

Also, the grains may be made of tungsten carbide, diamonds or the like.

Furthermore, the first machining bit may have a front face facing away from the tool towards the component to be removed, the first machining bit comprising a central bore extending from the front face towards the first gearing part.

In addition, the first machining bit may have a first rotation axis, and the second machining bit may have a second rotation axis, the first rotation axis being coincident with the second rotation axis.

Moreover, the downhole wireline tool may further comprise a reduction gear, such as a pericyclic gear, a wobbling gear or a nutating bevel gear, for reducing the rotational speed of the rotatable shaft.

Also, the pericyclic gear may be a pericyclic nutating gear such as a wobbling gear or a nutating bevel gear.

In addition, the reduction gear may be a pericyclic nutating gear such as a wobbling or a nutating bevel gear for reducing the rotational speed of the rotatable shaft with a reduction ratio of at least 1:10, preferably at least 1:50, more preferably at least 1:100, even more preferably at least 1:200, and even more preferably at least 1:1000.

Further, the pericyclic gear may comprise a reaction control member driven by the rotatable shaft, a pericyclic motion converter driven by the reaction control member, and an output gear driven by the pericyclic motion converter for driving an output rotatable shaft connected to the first gearing part.

Moreover, the reaction control member may be stationary and fixed to the housing of the tool.

Also, the pericyclic gear may be a double-sided nutating bevel gear.

In addition, the reduction gear may be arranged between the motor and the gearing system.

Moreover, the reduction gear may comprise bearings arranged between the rotatable shaft and the reaction control member, the pericyclic motion converter and the output gear.

Further, the teeth of the reaction control member may engage a first set of teeth of the pericyclic motion converter, and a second set of teeth of the pericyclic motion converter may engage teeth of the output gear, the output gear being connected to the output shaft.

Also, the downhole wireline tool may comprise a housing and a fixture for fixating the intermediate gearing part.

Furthermore, the downhole wireline tool may also comprise an electric control unit, the wireline connection unit being connected to the electric control unit.

In addition, the downhole wireline tool may further comprise a driving unit, such as a downhole tractor, for propelling the tool forward in the well.

Moreover, the downhole wireline tool may further comprise an anchoring section for anchoring the tool at a position in the well so that a first tool part of the tool comprising the wireline connection unit is prevented from moving along the axial extension.

Further, the tool may comprise a second tool part rotating in relation to the first tool part.

Also, the first machining bit may be a drill bit such as a pilot bit.

Finally, the invention relates to a downhole system comprising the downhole wireline tool and a driving unit, such as a downhole tractor, for propelling the downhole system forward in the well.

Figure 2:
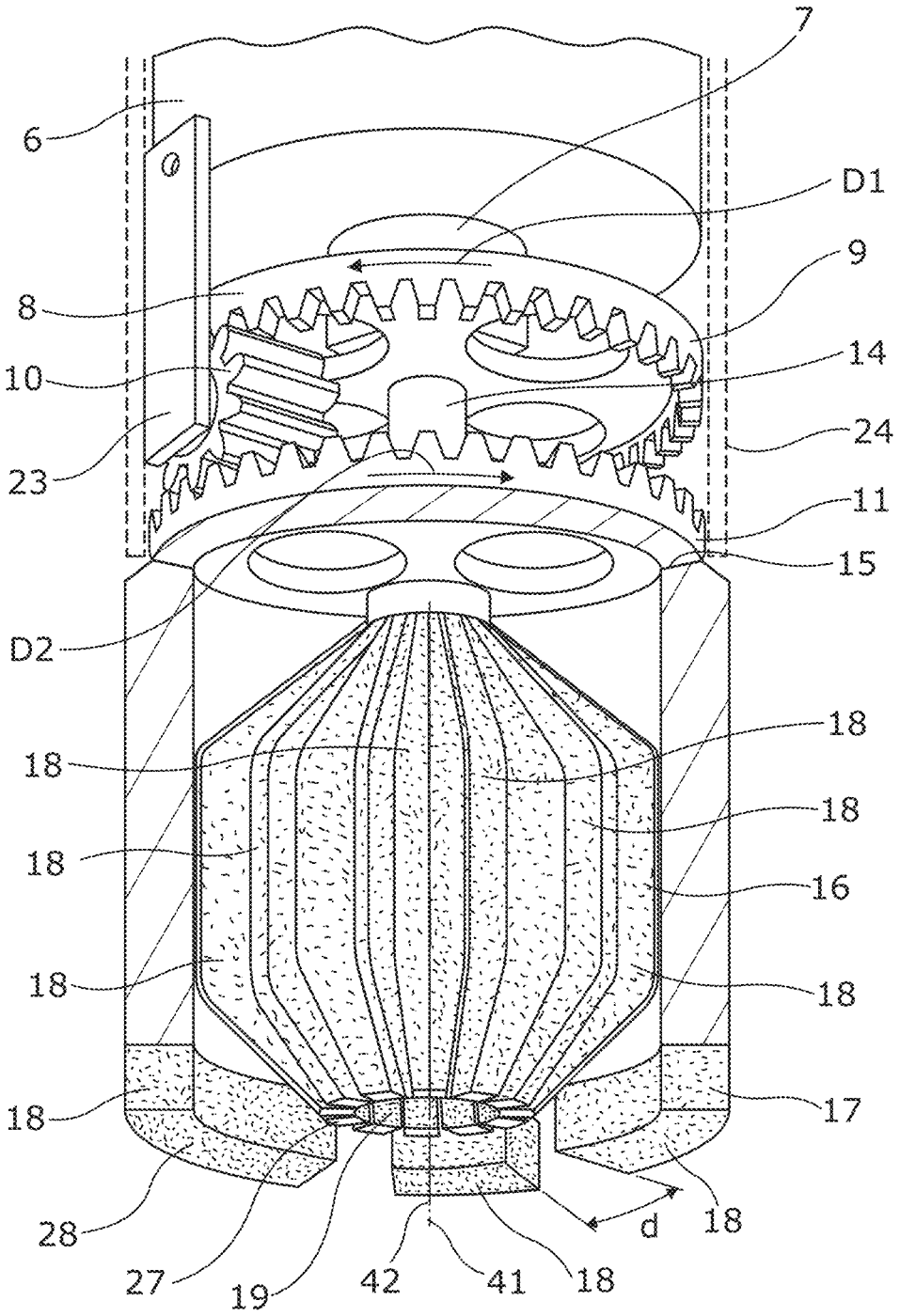
Figure 3:
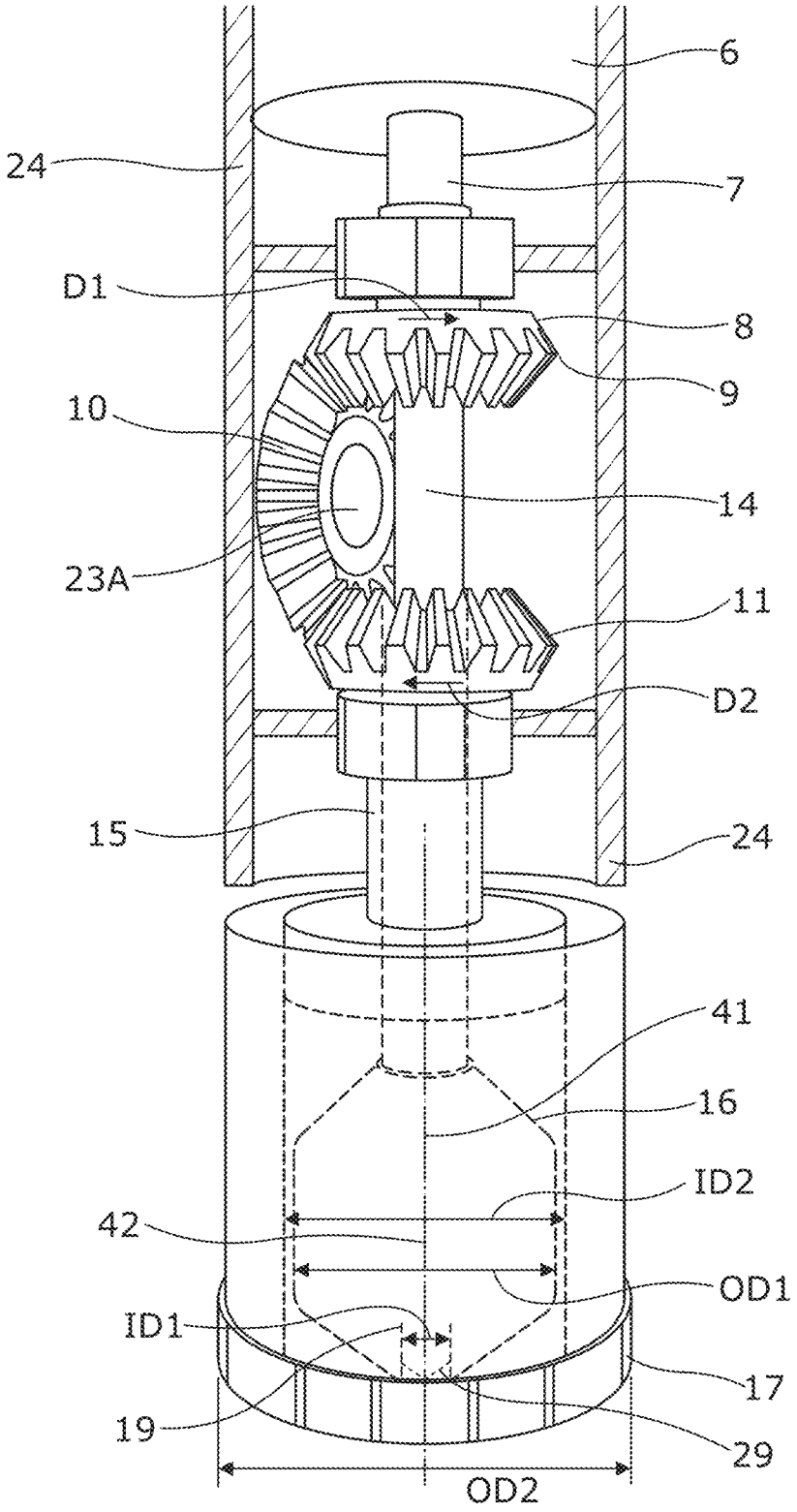
Figure 4:
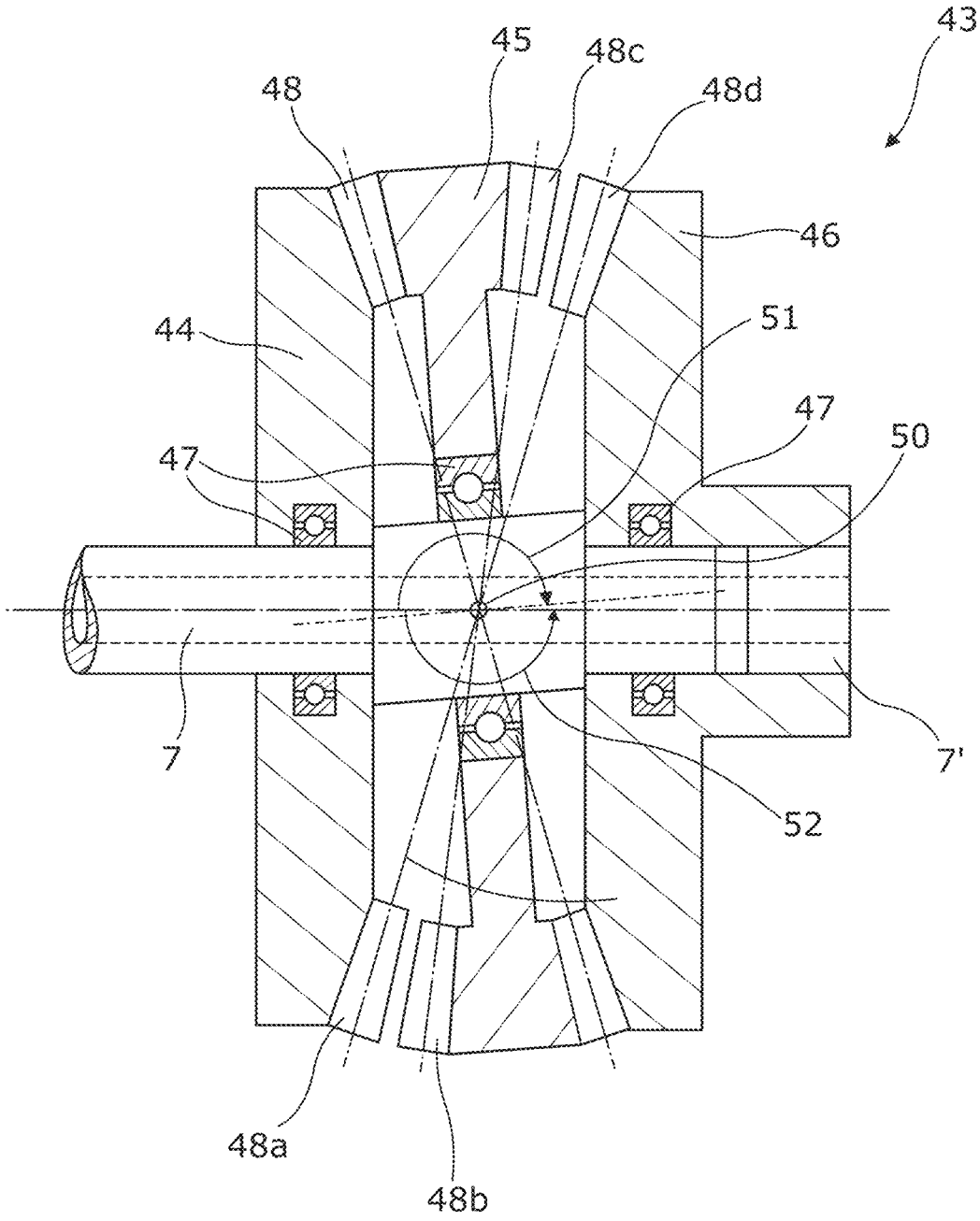
Figure 5:
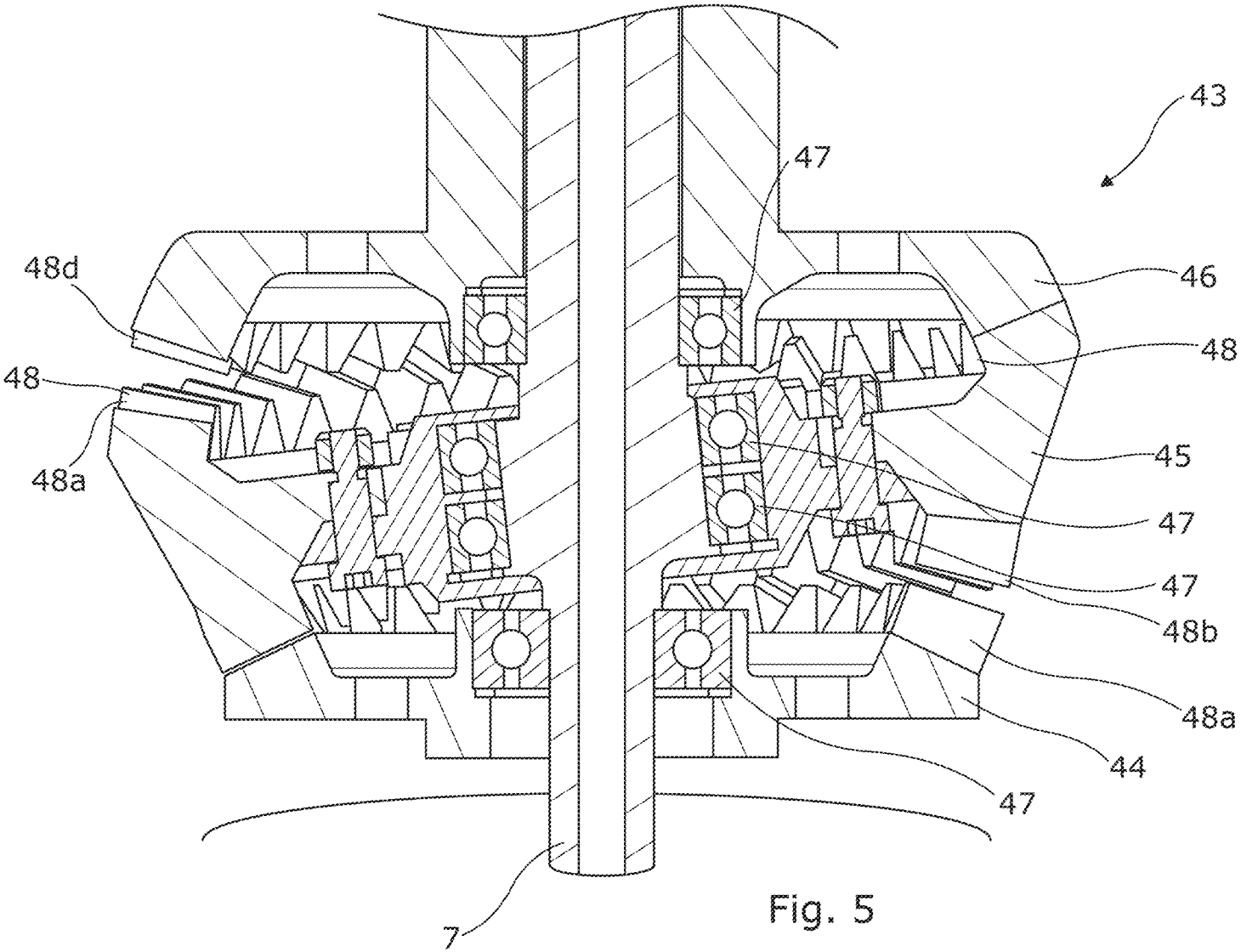
Figure 6:
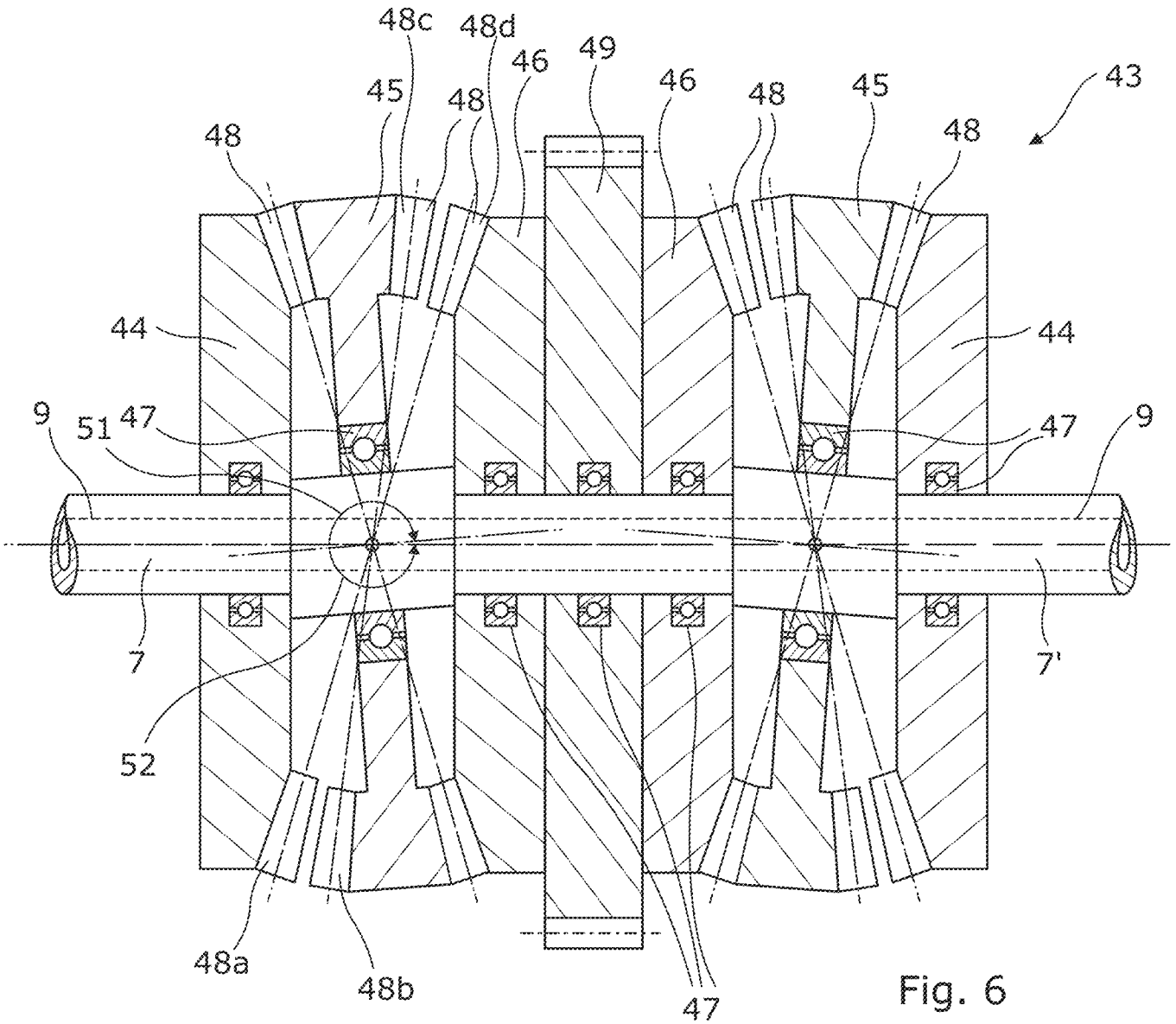
Figure 7:
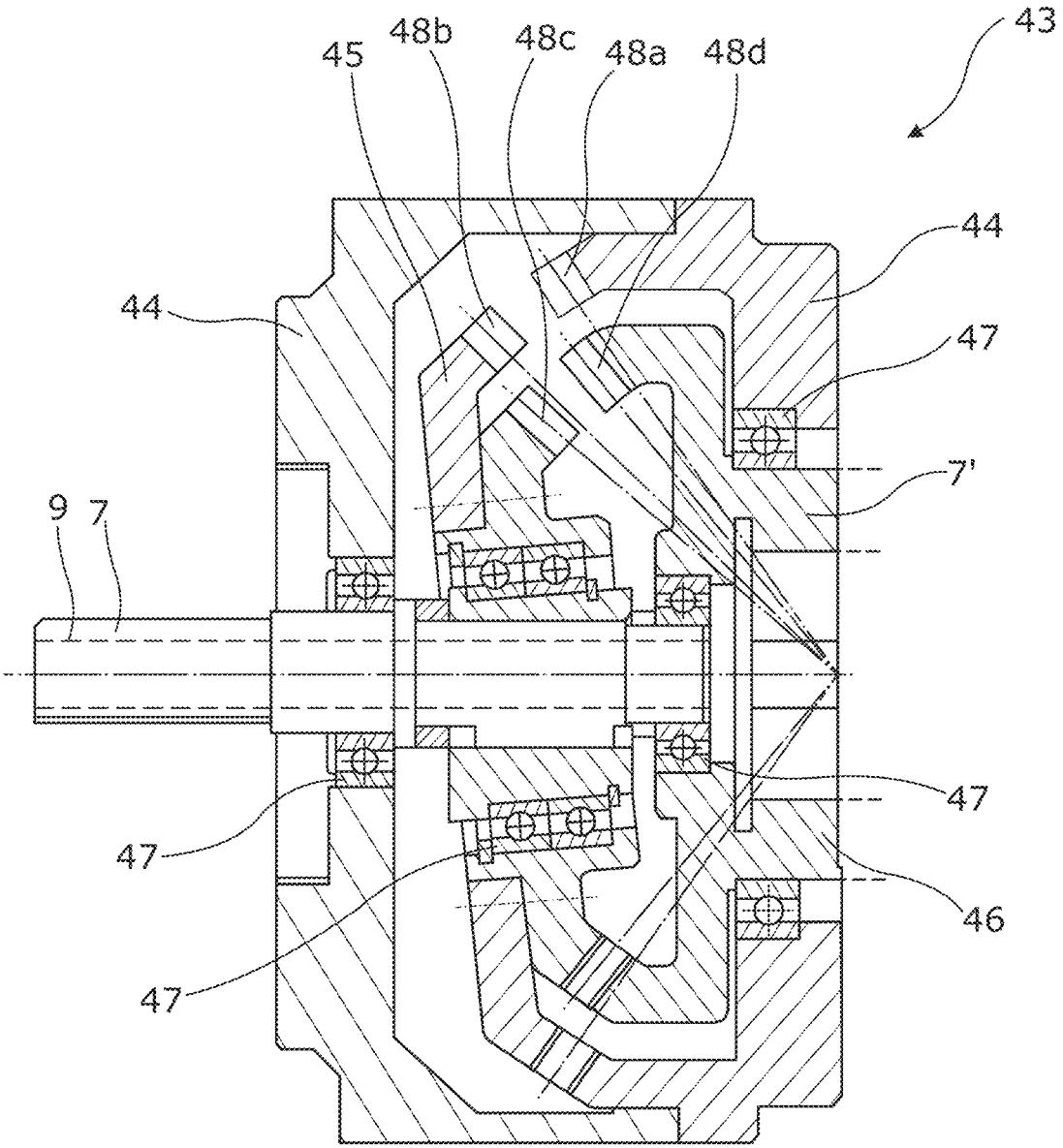
Figure 8:
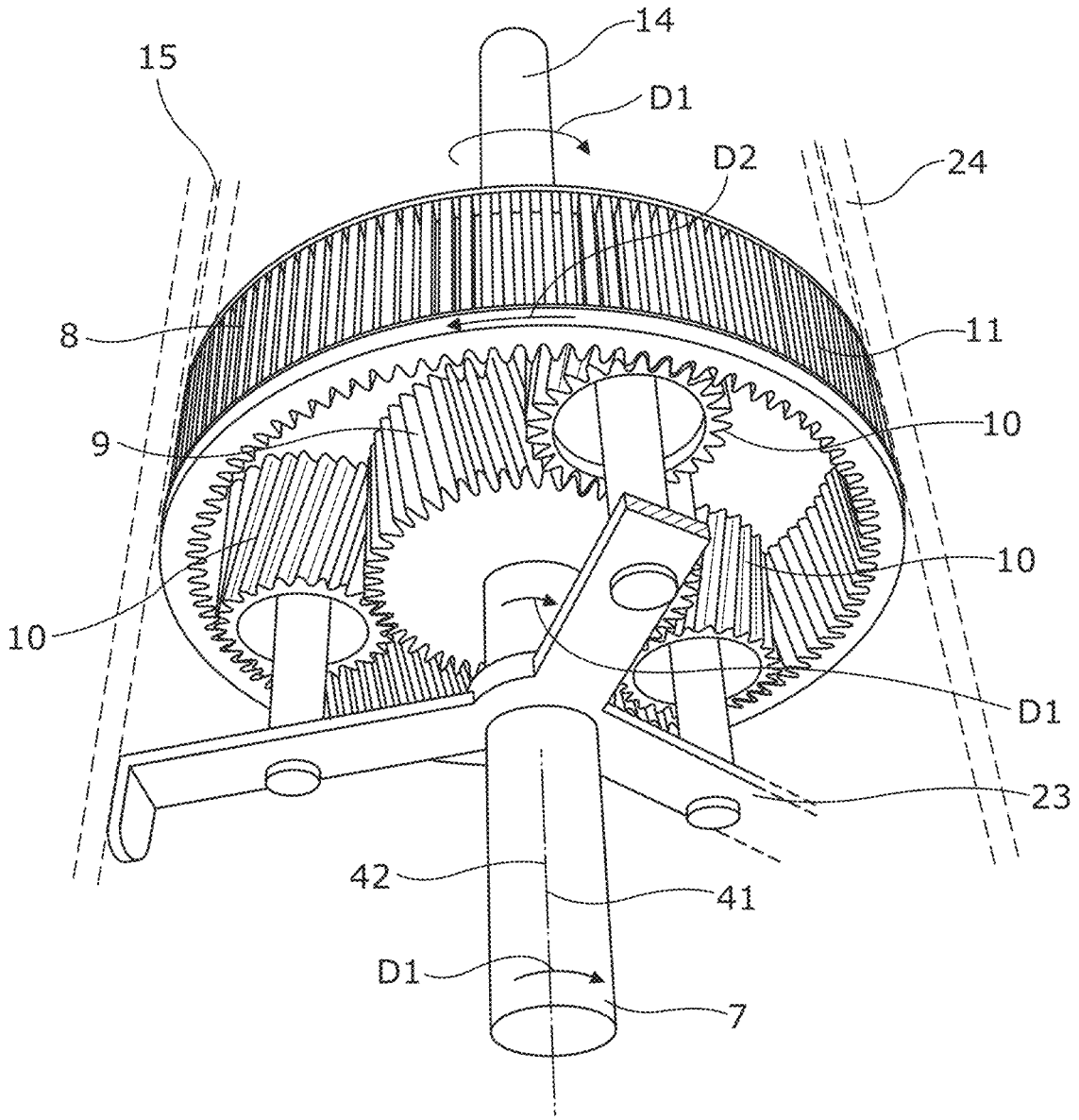

The invention and its many advantages will be described in more detail below with reference to the accompanying schematic drawings, which for the purpose of illustration show some non-limiting embodiments and in which:

FIG. 1 shows a partly cross-sectional view of a downhole wireline tool,

FIG. 2 shows a partly cross-sectional view of part of another downhole wireline tool having a gearing system comprising a first gearing part configured to rotate in a first direction and a second gearing part rotating opposite the first direction, FIG. 3 shows a partly cross-sectional view of part of yet another downhole wireline tool, FIG. 4 shows a partly cross-sectional view of a pericyclic gear of another downhole tool, FIG. 5 shows a cross-sectional view of another pericyclic gear of another downhole tool, FIG. 6 shows a cross-sectional view of yet another pericyclic gear of another downhole tool, FIG. 7 shows a cross-sectional view of yet another pericyclic gear of another downhole tool, and FIG. 8 shows another gearing system.

All the figures are highly schematic and not necessarily to scale, and they show only those parts which are necessary in order to elucidate the invention, other parts being omitted or merely suggested.

FIG. 1 shows a downhole wireline tool 1 for performing an operation on a rotatable component part mounted as part of a well tubular metal structure 20 in a well. The downhole wireline tool has an axial extension 2 along the extension of the well and a front face 3 facing down the well away from a top 25 of the well. The downhole wireline tool 1 comprises a wireline connection unit 4 for connection to a wireline 5, an electric motor 6 powered by the wireline 5 for rotating a rotatable shaft 7 (shown in FIG. 2) and a gearing system 8 driven by an electric motor 6. The gearing system 8 comprises a first gearing part 9 connected with the rotatable shaft 7 and configured to rotate in a first direction D1. The gearing system 8 further comprises an intermediate gearing part 10 rotated by the first gearing part 9 and a second gearing part 11 rotated by the intermediate gearing part 10 to rotate in a second direction D2 opposite the first direction D1. The first gearing part 9 is connected to a first output shaft 14 that is rotatable with the first gearing part 9 in the first direction D1, and the second gearing part 11 is connected to a second output shaft 15 that is hollow and rotatable with the second gearing part 11 in the second direction D2, the first output shaft 14 extending through the second output shaft 15.

By having the gearing system 8 providing a first rotation in the first direction D1 and a second rotation in the second direction D2, the downhole wireline tool 1 is able to also drill out rotating objects in a completion of a well in an easy, safe and quick manner.

The downhole wireline tool 1 further comprises a first machining bit 16 forming the front face 3 and connected to and rotated by the first output shaft 14. The first machining bit 16 is rotated for machining through a stuck completion component in the well, such as a stuck plug or a ball in a ball seat. The second output shaft 15 is a hollow shaft rotating around the first output shaft 14. The second output shaft 15 is connected to a gripping element or a second machining bit 17 forming the front face 3 and being connected to and rotated by the second output shaft 15. The second machining bit 17 is rotated in the second direction D2 opposite the first direction D1 so that the second machining bit 17 grips in the circumference of e.g. the rotatable ball; by rotating the second machining bit 17 in the second direction D2, the first machining bit 16 rotating in the first direction D1 is able to machine through the rotatable ball as the second machining bit 17 grips in the ball and fixates the ball in relation to the second machining bit 17 so that the first machining bit 16 is able to rotate in relation to the ball, which is required for the first machining bit 16 to be able to perform the machining operation. In FIG. 1, the second machining bit 17 is a tubular second machining bit having a circumference and circumferenting the first machining bit 16. The first machining bit 16 is also hollow. In another solution, the first machining bit 16 is a drill bit such as a pilot bit or a similar bit able to cut its way through the rotatable part of the component by drilling.

The operation on a rotatable component part mounted as part of the well tubular metal structure 20 may also be performed on a plug where the plug has a rotatable part at the upper part near its circumference, and the centre is fixed in relation to the well tubular metal structure. When removing such stuck plug by machining, the downhole wireline tool 1 needs to be able to rotate the inner part, i.e. the first machining bit, in relation to the plug, the second machining bit 17 being rotated in the opposite direction, and needs to be able to machine very closely to the circumference of the plug in order to remove as much of the plug as possible and provide as large an inner diameter of the well tubular metal structure as possible. The first machining bit 16 and the second machining bit 17 need to rotate in opposite directions and as closely to the circumference of the plug as possible, and thus both bits need to contact the rotatable part of the plug and at least one, the first machining bit, needs to be able to machine through the rotatable part. When machining through the rotatable part, the remaining machining operation is performed on the fixed part of the plug. Thus, the first machining bit 16 has a first outer diameter OD1, and the second machining bit 17 has a second inner diameter ID2 that is larger than the first outer diameter OD1. The first machining bit 16 is tubular, having a first inner diameter ID1 that is less than 10 mm smaller than the first outer diameter OD1, preferably less than 7 mm, and more preferably less than 5 mm. As shown in FIG. 3, the second machining bit 17 is tubular, having a second inner diameter ID2 that is less than 10 mm smaller than the second outer diameter OD2, preferably less than 7 mm, and more preferably less than 5 mm. The second inner diameter ID2 is less than 5 mm larger than the first outer diameter OD1, preferably less than 2 mm, so that the first machining bit 16 can machine very closely to the second machining bit 17 in order for both bits to engage the rotatable part of the plug.

In FIG. 2, the first machining bit 16 comprises inserts 18 extending from the front face along the axial extension 2. The second machining bit 17 also comprises inserts 18 extending from the front face along the axial extension 2. The inserts 18 are distributed along the circumference and with a distance d between the inserts 18. The inserts are abrasive inserts comprising grains and binder. The grains are made of tungsten carbide, diamonds or the like. As shown in FIG. 3, the first machining bit 16 has the front face 3 facing away from the tool towards the component to be removed, and the first machining bit 16 comprises a central bore 19 extending from the front face 3 towards the first gearing part 9.

In FIG. 2, the first machining bit has a first end face 27, the second machining bit has a second end face 28, and the first end face and the second face are arranged in the same plane extending transversely to the axial extension. Thus, the first end face and the second end face form the front face of the tool.

In FIG. 1, the first end face 27 of the first machining bit 16 and the second face 28 of the second machining bit 17 are arranged having an axial distance 26 along the axial extension, being less than 5 cm, preferably less than 2.5 cm in order to engage the curvature of a ball simultaneously.

The first machining bit 16, shown in FIG. 2, has a first rotation axis 41, and the second machining bit 17 has a second rotation axis 42, the first rotation axis 41 being coincident with the second rotation axis 42. The first machining bit 16 has the centre bore and is thus hollow, and a centre bit 29 is arranged inside the first machining bit 16. In this way, the centre part of the component is also grinded or even pulverised so that no large unmachined piece, also known as a coupon, is left in the well.

In order to rotate the first output shaft 14 in the first direction D1 and the second output shaft 15 in the opposite second direction D2, the gearing system 8 comprises the intermediate gearing part 10 rotated by the first gearing part 9 to rotate the second gearing part 11 in the second direction D2. In FIG. 2, the intermediate gearing part 10 is fixated in relation to a tool housing 24 by means of a fastening element 23 which is connected to the electric motor 6. The axis of rotation of the intermediate gearing part 10 is perpendicular to the first rotation axis 41 and the second rotation axis 42, and the teeth of the intermediate gearing part 10 engage both the teeth of the first gearing part 9 and the teeth of the second gearing part 11; thus, the rotation of the first gearing part 9 is transmitted to rotation of the second gearing part 11 in a direction opposite to the first direction D1. The second gearing part 11 forms part of the second machining bit 17, and the first output shaft 14 is connected to the first machining bit 16. The first output shaft 14 extends through the second gearing part 11. The first gearing part 9 and the second gearing part 11 have holes in order to reduce their weight. The gearing parts 9, 11 are conventional toothed gears.

In FIG. 3, the intermediate gearing part 10, the first gearing part 9 and the second gearing part 11 are bevel gears, and the intermediate gearing part 10 rotates around a bearing 23A which is connected to the tool housing 24 and forms the fastening element 23. The second gearing part 11 forms part of the second machining bit 17, the first output shaft 14 is connected to the first machining bit 16, and the first output shaft 14 extends through the second gearing part 11. The second machining bit 17 comprises a cutting element, e.g. in form of inserts, forming the front face 3. In another solution, the second output shaft 15 is connected to the gripping element having spikes or similar gripping parts for engaging the rotatable part of the component to be machined away, i.e. grinded or milled out.

In FIG. 8, the intermediate gearing part 10, the first gearing part 9 and the second gearing part 11 form a planetary gear having three intermediate gearing parts 10 forming the sun gears, the first gearing part 9 forming the centre gear, and the second gearing part 11 forming the ring gear. The three intermediate gearing parts 10 are rotating around pins on a carrier plate part 23B which is fixed to the tool housing 24 so that the carrier plate part 23B forms the fastening element 23. The second gearing part 11 is connected to the second output shaft 15 and rotates in the second direction D2. The first gearing part 9 is driven by the rotatable shaft 7 rotating in the first direction D1, and the first gearing part 9 rotates the first output shaft 14 in the first direction D1. The first output shaft 14 is connected to the first machining bit 16.

In order to reduce the rotational speed of the first output shaft 14, the downhole wireline tool 1 may further comprise a reduction gear 43, such as a pericyclic gear 43, as shown in FIG. 4, or a planetary gear, a harmonic drive gear or a cycloidal gear. The reduction gear may have multiple stages and may be a combination of more than one type of reduction gear. The pericyclic gear 43 may be a pericyclic nutating gear such as a wobbling gear or a nutating bevel gear for reducing the rotational speed of the rotatable shaft 7. The pericyclic gear 43 comprises a reaction control member 44 which is stationary and fixed to the housing of the tool, a pericyclic motion converter 45 driven by the rotatable shaft and interacting with the reaction control member 44, an output gear 46 driven by the pericyclic motion converter 45 for driving an output rotatable shaft 7' connected to the first gearing part 9. The pericyclic motion converter 45 is the wobbling element. The nutating wobble motion will cause fluctuating moments around an axis 50 which alternates between a CW direction 51 and a CCW direction 52. The rotational speed of the rotatable shaft 7 is thus reduced at the output rotatable shaft 7'. The rotatable shaft 7, the output rotatable shaft 7' and the centre part of the pericyclic gear 43 are hollow so that electric lines or hydraulic lines can pass through them. Teeth 48, 48*a* of the reaction control member 44 engage a first set of teeth 48, 48*b* of the pericyclic motion converter 45, and a second set of teeth 48, 48*c* of the pericyclic motion converter 45 engages teeth 48, 48*d* of the output gear 46, which is connected to the output rotatable shaft 7'. The reaction control member 44 has the teeth 48*a* with a teeth number Z1 engaging the teeth 48*b* with a teeth number Z2 on one side of the pericyclic motion converter 45, and on the other side of the pericyclic motion converter 45, the teeth 48*c* with a teeth number Z3 engage the teeth 48*d* with a teeth number Z4 of the output gear 46 in order to reduce the rotational speed of the rotatable 7. The teeth number Z1 is one tooth 48 less than the teeth number Z2, and the teeth number Z3 is one tooth less than the teeth number Z4. The teeth number Z1/Z2 may be 40/41, and the teeth number Z3/Z4 may be 61/60, which corresponds to a reduction ratio of 1:123. The teeth number Z1/Z2 may also be 20/21, and the teeth number Z3/Z4 may be 32/31, which corresponds to a reduction ratio of 1:59. Thus, the reduction ratio may be up to 1:1000. The reduction gear 43 is thus a double or two-sided nutating bevel gear or wobbling gear. In FIG. 4, the pericyclic gear 43 is a reduction gear for reducing rotation of the rotational shaft with a reduction ratio of at least 1:10, preferably at least 1:50, more preferably at least 1:100, even more preferably at least 1:200, and even more preferably at least 1:1000.

By using a pericyclic gear 43 such as a wobbling gear or a nutating bevel gear for reducing the rotational speed of the rotatable shaft 7, the reduction gear 43 has a higher efficiency than conventional planetary reduction gears. The wobbling gear or nutating bevel gear is also more robust, easier to mount and requires less space. In downhole wireline tools, the tools are internally pressure-compensated, and thus fluid surrounding the tool components acts against any motion, which means that by using a wobbling gear or a nutating bevel gear, the efficiency is higher as the teeth do not intentionally act as "scoop wheels". By using a pericyclic gear such as a wobbling gear or a nutating bevel gear, more teeth are engaging each other at the same time resulting in a higher strength of the gear and that higher force can be transmitted and that each tooth may be made more strong.

The reduction gear 43 is arranged between the electric motor 6 and the gearing system 8, providing the double rotational movement. The reduction gear 43 comprises bearings 47 arranged between the rotatable shaft 7 and the reaction control member 44, the pericyclic motion converter 45 and the output gear 46, as shown in FIG. 5. The bearing within the pericyclic motion converter 45 and between the rotatable shaft 7 and the pericyclic motion converter 45 is rotating around an axis being inclined in relation to the axial extension of the tool. Thus, the rotatable shaft 7 is fixedly connected with the centre of the bearing 47 within the pericyclic motion converter 45. The rotatable shaft 7 is also fixedly connected to the centre of the bearing 47 arranged within the output gear 46.

In FIG. 5, the reduction gear 43 is also a wobbling gear or a nutating bevel gear, and the output gear 46 has a larger diameter than that of the reaction control member 44. The wobbling pericyclic motion converter 45 has a diameter on one side matching the diameter of the output gear 46 and on the other side a diameter matching the diameter of the reaction control member 44. By having varying diameters, the reduction gear 43 can be made with an overall smaller outer diameter than that in FIG. 4. As can be seen, the rotatable shaft 7 and the output rotatable shaft 7' have a hollow passage for electric lines and/or hydraulic lines.

FIG. 6 shows a reduction gear 43 which is a balanced pericyclic transmission in that the reduction gear of FIG. 4 is supplemented with a balancing part of a similar configuration in order to outbalance any vibration caused by the reduction gear 43 of FIG. 4. Thus, the wobbling pericyclic motion converter 45 on both sides of the balancing part 49 is either moving against each other as shown in the bottom of FIG. 6 or towards each other as shown in the top of FIG. 6 in order to outbalance the movement. The function of the reduction gear 43 shown in FIG. 6 is the same as the reduction gear 43 shown in FIG. 4. The rotatable shafts 7, 7' are hollow, and the number of teeth is the same.

The reduction gear 43 shown in FIG. 7 also comprises a wobbling pericyclic motion converter 45 as in FIGS. 4-6, but the set of teeth 48*b* engaging the teeth 48*a* of the reaction control member 44 is positioned on the same side of the wobbling pericyclic motion converter 45 as the teeth 48*c* engaging the teeth 48*d* of the output gear 46. The reduction gear 43 of FIG. 7 has a larger outer diameter OD than that of the gears in FIGS. 4-6, but a shorter extension along the axial extension 2 for the same strength and number of teeth. The rotatable shafts 7, 7' are hollow for electric and/or hydraulic feedthrough.

In FIG. 1, a downhole system 100 is shown comprising the downhole wireline tool 1 and a driving unit 32, such as a downhole tractor, for propelling the downhole system forward in the well. The downhole wireline tool 1 further comprises an electric control unit 31, and the wireline connection unit 4 is connected to the electric control unit 31. The downhole wireline tool 1 also comprises an anchoring section 33 for anchoring the tool at a position in the well so that a first tool part 21 of the tool comprising the wireline connection unit 4 is prevented from moving along the axial extension 2. The downhole wireline tool 1 comprises a second tool part 22 rotating in relation to the first tool part 21, the second tool part 22 comprising the first machining bit 16.

By fluid or well fluid is meant any kind of fluid that may be present in oil or gas wells downhole, such as natural gas, oil, oil mud, crude oil, water, etc. By gas is meant any kind of gas composition present in a well, completion or open hole, and by oil is meant any kind of oil composition, such as crude oil, an oil-containing fluid, etc. Gas, oil and water fluids may thus all comprise other elements or substances than gas, oil and/or water, respectively.

By casing or well tubular metal structure is meant any kind of pipe, tubing, tubular, liner, string, etc., used downhole in relation to oil or natural gas production.

In the event that the tool is not submergible all the way into the casing, a downhole tractor can be used to push the tool all the way into position in the well. The downhole tractor may have projectable arms having wheels, wherein the wheels contact the inner surface of the casing for propelling the tractor and the tool forward in the casing. A downhole tractor is any kind of driving tool capable of pushing or pulling tools in a well downhole, such as a Well Tractor®.

Although the invention has been described above in connection with preferred embodiments of the invention, it will be evident to a person skilled in the art that several modifications are conceivable without departing from the invention as defined by the following claims.

The invention claimed is:

1. A downhole wireline tool for performing an operation on a rotatable component part mounted as part of a well tubular metal structure in a well, the downhole wireline tool having an axial extension and a front face facing away from a top of the well, and the downhole wireline tool comprising:

a wireline connection unit for connection to a wireline, an electric motor powered by the wireline for rotating a rotatable shaft, and a gearing system driven by the electric motor, the gearing system comprising a first gearing part connected with the rotatable shaft and configured to rotate in a first direction, wherein the gearing system further comprises an intermediate gearing part rotated by the first gearing part and a second gearing part rotated by the intermediate gearing part to rotate in a second direction opposite the first direction.

2. The downhole wireline tool according to claim 1, wherein the first gearing part is connected to a first output shaft that is rotatable with the first gearing part in the first direction, and the second gearing part is connected to a second output shaft that is hollow and rotatable with the second gearing part in the second direction, the first output shaft extending through the second output shaft.

3. The downhole wireline tool according to claim 2, further comprising a first machining bit forming the front face and connected to and rotated by the first output shaft.

4. The downhole wireline tool according to claim 3, wherein the first machining bit comprises inserts extending from the front face along the axial extension.

5. The downhole wireline tool according to claim 4, wherein the inserts are abrasive inserts.

6. The downhole wireline tool according to claim 3, wherein the first machining bit has a first rotation axis, and the second machining bit has a second rotation axis, the first rotation axis being coincident with the second rotation axis.

7. The downhole wireline tool according to claim 3, wherein the second machining bit comprises inserts extending from the front face along the axial extension.

8. The downhole wireline tool according to claim 2, wherein the second output shaft is a hollow shaft rotating around the first output shaft.

9. The downhole wireline tool according to claim 8, wherein the first machining bit has a first outer diameter, and the second machining bit has a second inner diameter that is larger than the first outer diameter.

10. The downhole wireline tool according to claim 2, wherein the second output shaft is connected to a gripping element or a second machining bit forming the front face and connected to and rotated by the second output shaft.

11. The downhole wireline tool according to claim 10, wherein the second machining bit is a tubular second machining bit having a circumference and circumferenting the first machining bit.

12. The downhole wireline tool according to claim 11, wherein the second machining bit comprises inserts distributed along the circumference.

13. The downhole wireline tool according to claim 1, further comprising a reduction gear, such as a pericyclic gear, a wobbling gear or a nutating bevel gear, for reducing the rotation of the rotatable shaft.

14. The downhole wireline tool according to claim 1, wherein the first machining bit is a drill bit such as a pilot bit.

15. A downhole system comprising the downhole wireline tool according to claim 1 and a driving unit, such as a downhole tractor, for propelling the downhole system forward in the well.

* * * * *